United States Patent [19]

Nishimura

[11] 4,443,692

[45] Apr. 17, 1984

[54] CASH ACCOUNTING SYSTEM

[75] Inventor: Katsuji Nishimura, Habikino, Japan

[73] Assignee: Sharp Kabushiki Kaisha, Osaka, Japan

[21] Appl. No.: 433,162

[22] Filed: Oct. 6, 1982

[30] Foreign Application Priority Data

Oct. 9, 1981 [JP] Japan ..... 56-161400

[51] Int. Cl.[3] ..... G06R 16/30

[52] U.S. Cl. ..... 235/379; 235/375

[58] Field of Search ..... 235/379; 194/4; 221/13; 209/534

[56] References Cited

U.S. PATENT DOCUMENTS 3,949,364 4/1976 Clark ..... 235/379 X

*Primary Examiner*—Harold I. Pitts

*Attorney, Agent, or Firm*—Birch, Stewart, Kolasch & Birch

[57] ABSTRACT

Improvements in a cash accounting system for use in the window services such as a bank or the like. In the accounting system, a cash register for registering the various cash transaction information is electrically connected with a money paying-out apparatus for paying-out money such as papers, coins or the like in accordance with the paying-out money amount produced by each transaction registration.

1 Claim, 12 Drawing Figures

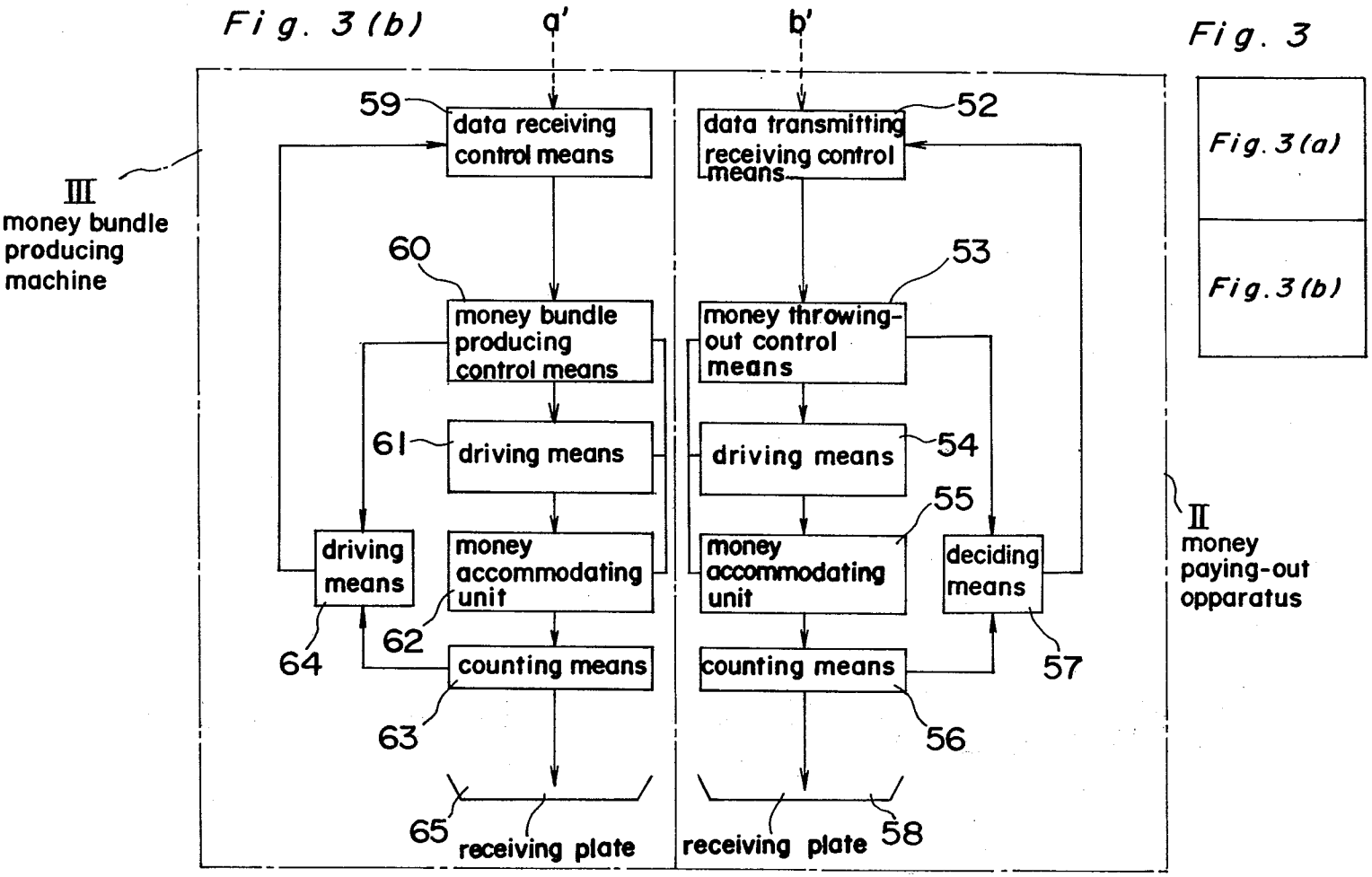
Fig. 3
Fig. 3(a)
Fig. 3(b)
II money paying-out opparatus
b'
data transmitting receiving control means
52
money throwing-out control means
53
driving means
54
money accommodating unit
55
counting means
56
deciding means
57
receiving plate
58
a'
data receiving control means
59
money bundle producing control means
60
driving means
61
money accommodating unit
62
counting means
63
driving means
64
receiving plate
65
Fig. 3(b)
III money bundle producing machine

CASE ACCOUNTING SYSTEM

BACKGROUND OF THE INVENTION

1. Field of the Invention

The present invention relates to improvements in a cash accounting system for use in the window services such as a bank or the like and particularly to improvements in a cash accounting system where a cash register for registering the various cast transaction information is electrically connected with a money paying-out apparatus for paying out money such as papers, coins or the like in accordance with the paying-out money amount produced by each transaction registration.

2. Description of the Prior Art

Conventionally a cash accounting system for paying-out business, which is used in the window service of a bank or the like, is constructed as shown in FIG. 1.

Namely, referring to FIG. 1, reference nuneral I is a cash register, reference numeral II is a money paying-out apparatus, they are electrically connected with each other through a connection line L. In the cash register I, reference numeral 1 is a function keyboard of item keys or the like, including a payment key a, a payment-out instruction key T. Reference numeral 2 is a key deciding means of the function keyboard 1. Reference numeral 3 is a central processing unit (CPU). Reference numeral 4 is a numeral-value information input means. Reference numeral 5 is a key encoder. Reference numeral 6 is a money denomination key. Reference numeral 7 is an address counter. Reference numeral 8 is a primary memory for storing various data, the primary memory is provided with a money memory area b and a transaction total money area c. Reference numeral 9 is an input/output control means for controlling the memory 8. Reference numeral 10 is a printer. Reference numeral 11 is a display. Reference numeral 12 is a read-only memory (ROM) for storing a micro-program necessary to control the sequence of operation of the apparatus. Reference numeral 13 is a mode selection means for setting the operation mode of the apparatus to a set mode. Reference numeral 14 is an AND gate. Reference numeral 15 is a memory means for possible throwing-out amount wherein the information of the money-bill-number (or money amount), which can be paid out in one paying-out operation, by a money paying-out apparatus (to be described later), at the set mode is set and stored. Reference numeral 16 is a comparison means. Reference numeral 17 is a secondary memory for storing the various registration data. Also, reference numeral 18 is a data transfer means, which is adapted to feed each money denomination information of the money to be paid out onto the side of the money paying-out apparatus II through a connection line L.

Also, in the money paying-out apparatus II, reference numeral 19 is a data transmitting, receiving control means for receiving each money denomination paying-out information fed from the side of the cash register I. Reference numeral 20 is a money throwing-out control means. Reference numeral 21 is a driving means, which receives the signal of the money throwing-out control means 20 to drive the money throwing-out mechanism of a money accommodating portions 22, which are separately accommodated for each of the money denominations. Reference numeral 23 is a counting means, which counts the number of the throwing-out money only to stop the throwing-out operation when the money comes to the specified number. Reference numeral 24 is a throwing-out completion deciding means, which decides the completion of the throwing-out operation of all the specified money to send the throwing-out completion signal, through the data transmitting, receiving control means 19, onto the side of the cash register I. Reference numeral 25 is a receiving plate, which receives the thrown-out money.

With the above-described construction, in the case where the cash paying-out operation for paying out 2,300,000 yen (1,200,000 yen in bills of 10,000 yen and 1,100,000 yen in bills of 5,000 yen) is desired to be performed from an ordinary account by the use of the cash accounting system, the system is operated in a manner as shown in the flow chart of FIG. 2. An operator depresses a given item specifying key of the function keyboard 1 to instruct that the subsequent registrating operation is associated with the ordinary account to the CPU 3 through the key discriminating means 2 (step $n_1$, FIG. 2). Then, the operator inputs the transaction money-amount information (2,300,000 yen) to the CPU 3 from a numerical-value information input means 4 through a key encoder 5 (step $n_2$). Then, the operator depresses a payment key a of the function keyboard 1 to instruct that the money-amount information is associated with the paying thereby to give the payment instruction to the CPU 3 through the key discriminating means 2 (step $n_3$). The operator inputs the contents (1,200,000 yen in bills of 10,000 yen and 1,100,000 yen in bills of 5,000 yen) of the payment money-amount to the CPU3 by the use of the numerical-value information input means 4 and the money denomination key 6 (step $n_4$). The money-amount information inputted in this manner is inputted into and memorized in, through an input/output control means 9, the given money denomination memory area b and transaction total money area c of the memory 8 to be specified by an address counter 7, and is printed on a slip or journal paper in a printing portion 10 and displayed on a display portion 11.

Also, the number information of each of the money denominations specified in the payment money-denomination is inputted to one input end of the comparison means 16 to decide whether or not the number can be thrown out in one throwing-out operation of the money paying-out apparatus II. The thrown-out number inputted now is compared with the number information of each money denomination, memorized in a throwable amount memory means 15, by the comparison means 16 (step $n_5$). If the number of the throwing-out is more than a given number, an error display is performed to prohibit the throwing-out operation (step $n_6$). If the number of the throwing-out stays within the given number, the throwing-out operation is allowed to be effected.

Assume that the throwable number in one throwing-out operation of the money paying apparatus II connected with the cash register I is set through the AND gate 14 to the throwable amount memory means 15 in the condition of a set mode, which was set by the mode selection means 13 before this system is used (99 bills are normally memorized about each money denomination).

Accordingly, in this case, as bills of 10,000 yen and 5,000 yen in money denomination exceeds 100, the throwing-out operation is prohibited. The system is put into its error condition, thus preventing the transaction registration. The operator is required to perform the registrating operation over again, i.e., to perform the registration by a plurality of throwing-out times so that throwing-out operation may be performed with respect to 100 bills or less.

When the number of the throwing-out instruction is lower than the given number, the operator depresses the throwing-out instruction key T of the function keyboard 1 so as to throw out the money amount of the specified money denomination (step $n_7$). The throwing-out instruction is given to the CPU 3 through a key deciding means 2. The CPU 3, which received the throwing-out instruction transfers the throwing-out instruction signal, together with the money denomination data of the area b of the money 8, as the money throwing-out instruction data to the data transmitting, receiving control means 19 on the side of the money paying-out apparatus II through a data transfer means 18. The money paying-out apparatus II (step $n_8$) which received the throwing-out instruction and the money denomination data throws out, to the receiving plate 25, the number specified by a driving means 21 from each money accommodating means 22 under the control of the throwing-out control means 20 (step $n_9$). At this time, the number of the throwing-out is counted by a counting means 23. When the number comes to a specified number, the throwing-out operation stops. At the completion of the throwing-out operation of all the specified money denomination in this manner, the throwing-out completion deciding means 24 is operated (step $n_{10}$) to transfer the throwing-out completion instruction to the cash register I from the data transmitting control means 19 (step $n_{11}$).

The cash register I receives the throwing-out completion instruction signal through a data transfer means 18 (step $n_{12}$). The CPU 3 which received this completion instruction effects a zero-proof processing to see whether or not the payment total previously inputted and memorized in the area c of the memory 8 conforms to the total, of the money denomination contents, memorized in the memory area b (step $n_{13}$). When they conform to each other, the memory data of the memory 8 is stored in the secondary memory 27 through the input-/output control means 9 to clear the memory data of the areas b, c of the memory 8 (steps $n_{14}$, $n_{15}$).

It is to be noted that the above-described sequence of the operation is controlled by the micro-program stored in the ROM 12.

As described hereinabove, the conventional cash accounting system has disadvantages in that when the number of the throwing-out instruction of each money denomination in each transaction is instructed to exceed the number, which can be thrown out through one throwing-out action by the memory throwing-out apparatus in the system, the throwing-out operation is prohibited and the system is put into its error condition, thus preventing the transaction registration from being performed, with the result of complicated registrating operation.

SUMMARY OF THE INVENTION

The present invention has, accordingly, for its object to provide an improved cash accounting system substantially free from the above-discussed disadvantages and inconveniences.

In order to accomplish this and other objects of the present invention, the present invention provides a cash accounting system of a type wherein a cash register for registering information concerning transaction of money is electrically connected with a money paying-out apparatus for paying out the money such as papers, copies or the like in accordance with the paying-out amount produced by each transaction registration. A money bundle producing machine for paying out money for each of given amount units is electrically connected with the cash register. A deciding means is provided to decide whether or not the paying-out information for each money denomination corresponding to the above-described money amount is a predetermined given-amount or more. The money amount of the given amount or less is thrown out from the money paying-out apparatus in accordance with the decision output of the deciding means. The money of integer magnification of the given amount is adapted to be thrown out of the money bundel producing machine. With such construction as described hereinabove, when the throwing out instruction is given, the instructed number is compared in number with the throwing-out tolerance number to throw out the specified denomination money amount as it is by the money paying-out apparatus when the compared result is smaller. When the compared result is larger, the bundle producing money amount (100-bill unit) included within the specified money amount is decided. When the money amount has been decided to be less than the bundle producing money amount in the decided result, the money amount is thrown out by the money paying-out apparatus. The other money amounts are adapted to be thrown out by the bundle producing machine.

BRIEF DESCRIPTION OF THE DRAWINGS

This and other objects and features of the present invention will become apparent from the following description taken in conjunction with preferred embodiment thereof with reference to the accompanying drawings, in which.

DETAILED DESCRIPTION OF THE INVENTION

Figure 1B:
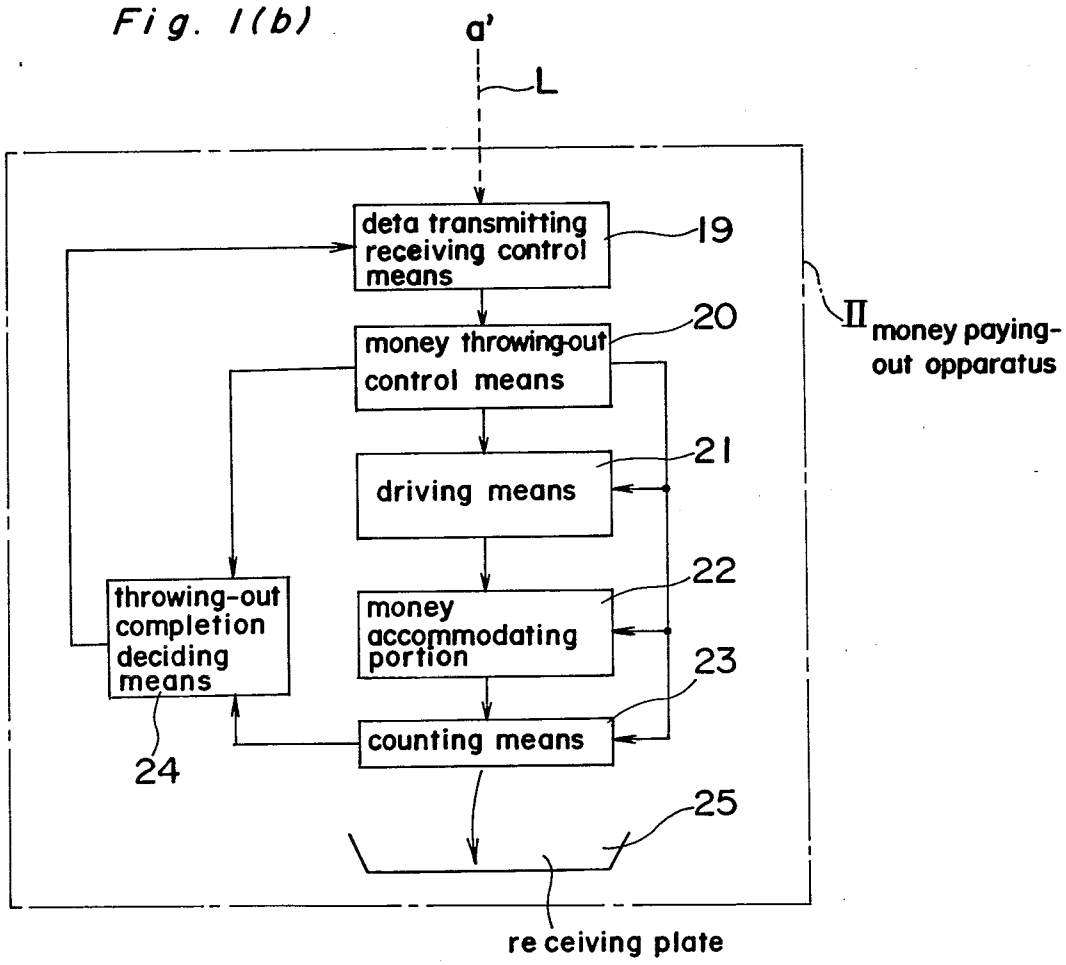
FIGS. 1(*a*) and 1(*b*) are a schematic block diagram showing the construction of the conventional cash accounting system as already referred above.
Figure 1:
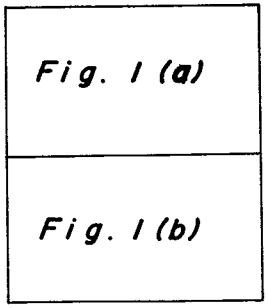
Figure 1A:
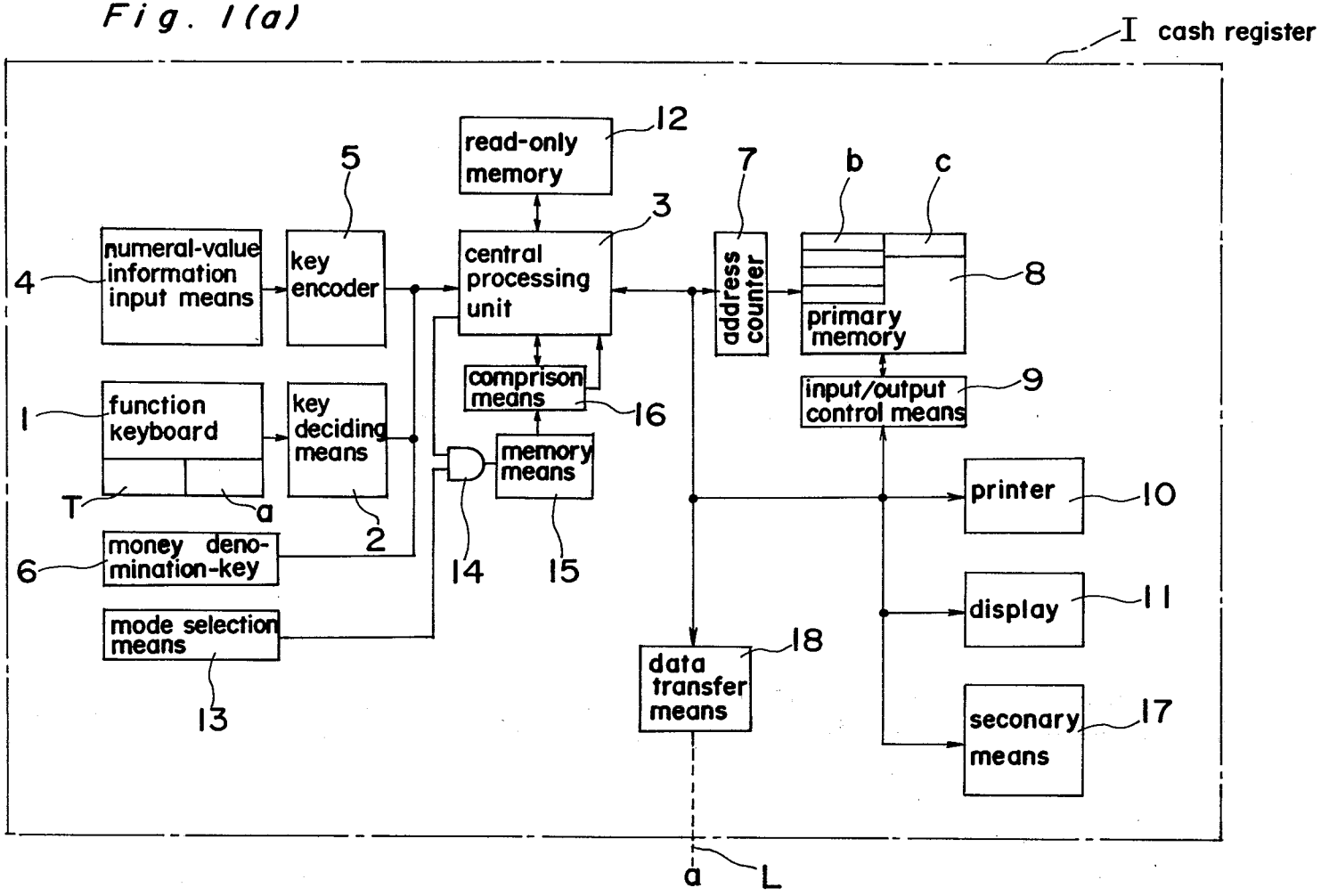
Figure 2:
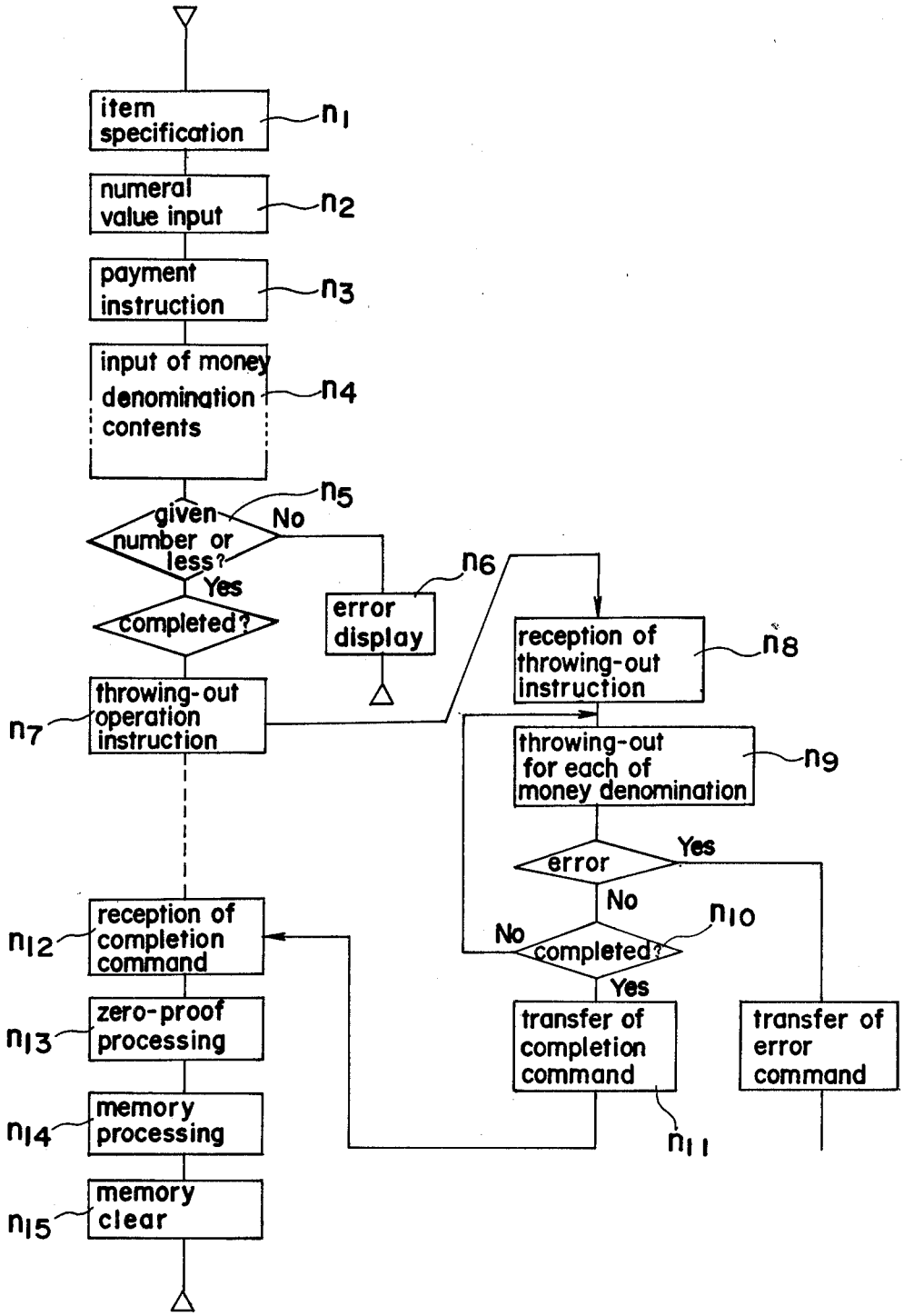
FIG. 2 is an operation flow chart illustrating the operation of the system of FIG. 1.
Figure 3A:
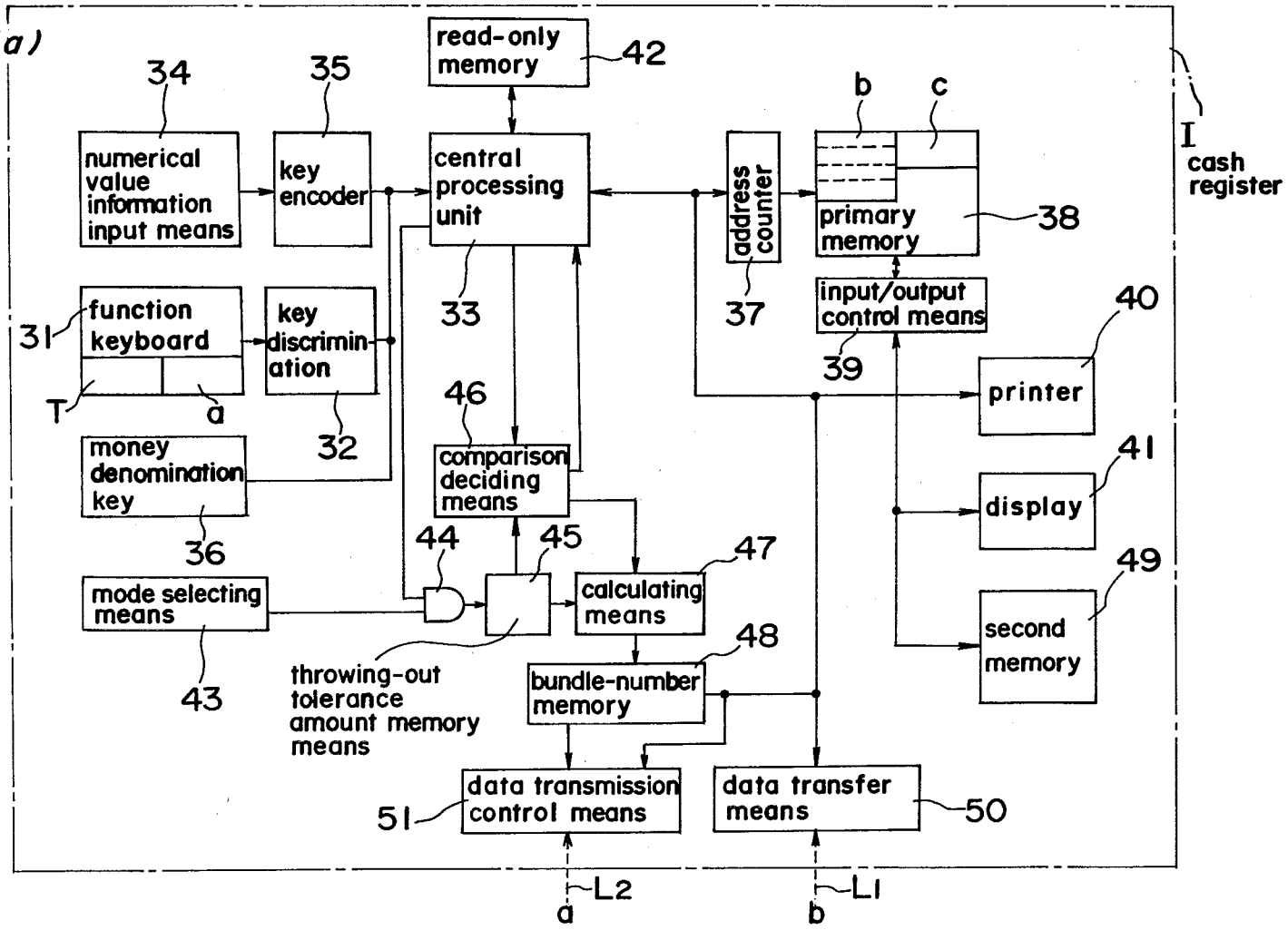
FIGS. 3(*a*) and 3(*b*) are a schematic block diagram showing the construction of the cash accounting system of the present invention.
Figure 4:
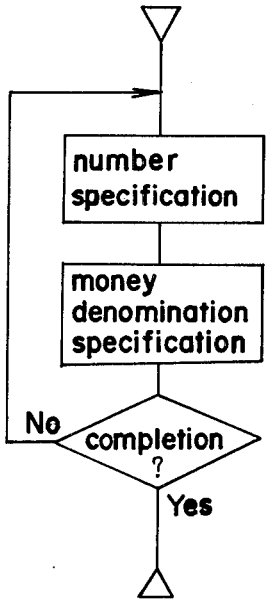
FIGS. 4(*a*) and 4(*b*)-1, 4(*b*)-2 and 4(*b*)-3 are an operation flow chart for illustrating the operation of the system of FIG. 3.
Figure 4B:
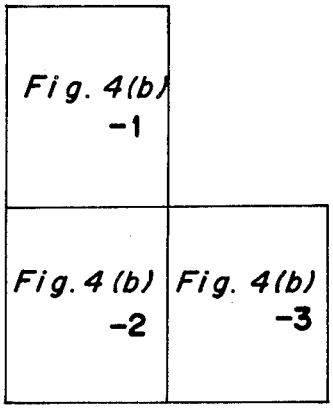
Figures 1, 4B:
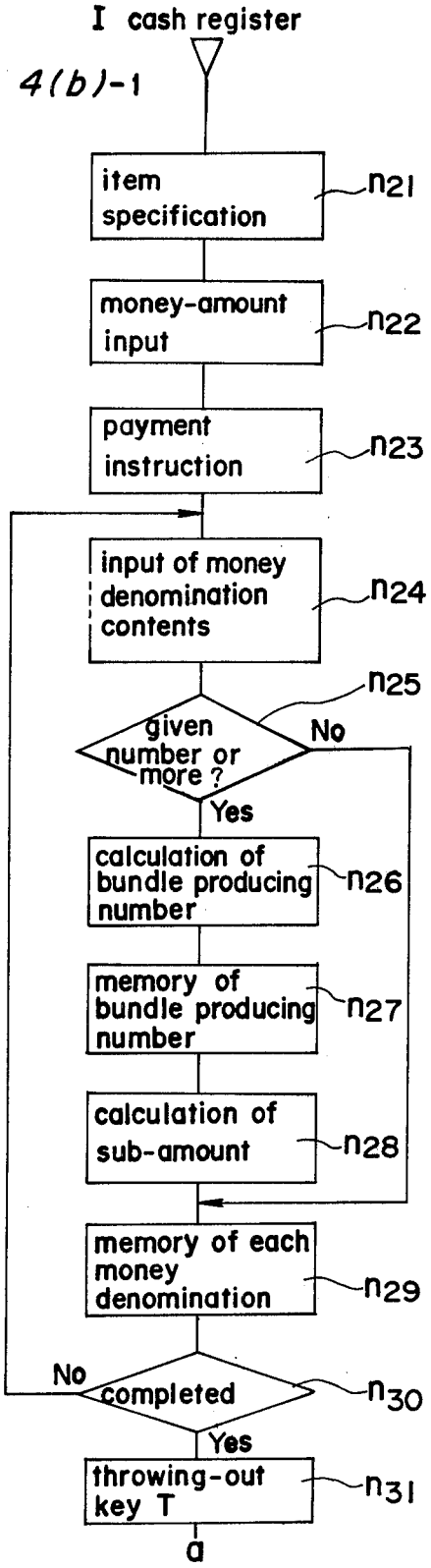
Figures 2, 4B:
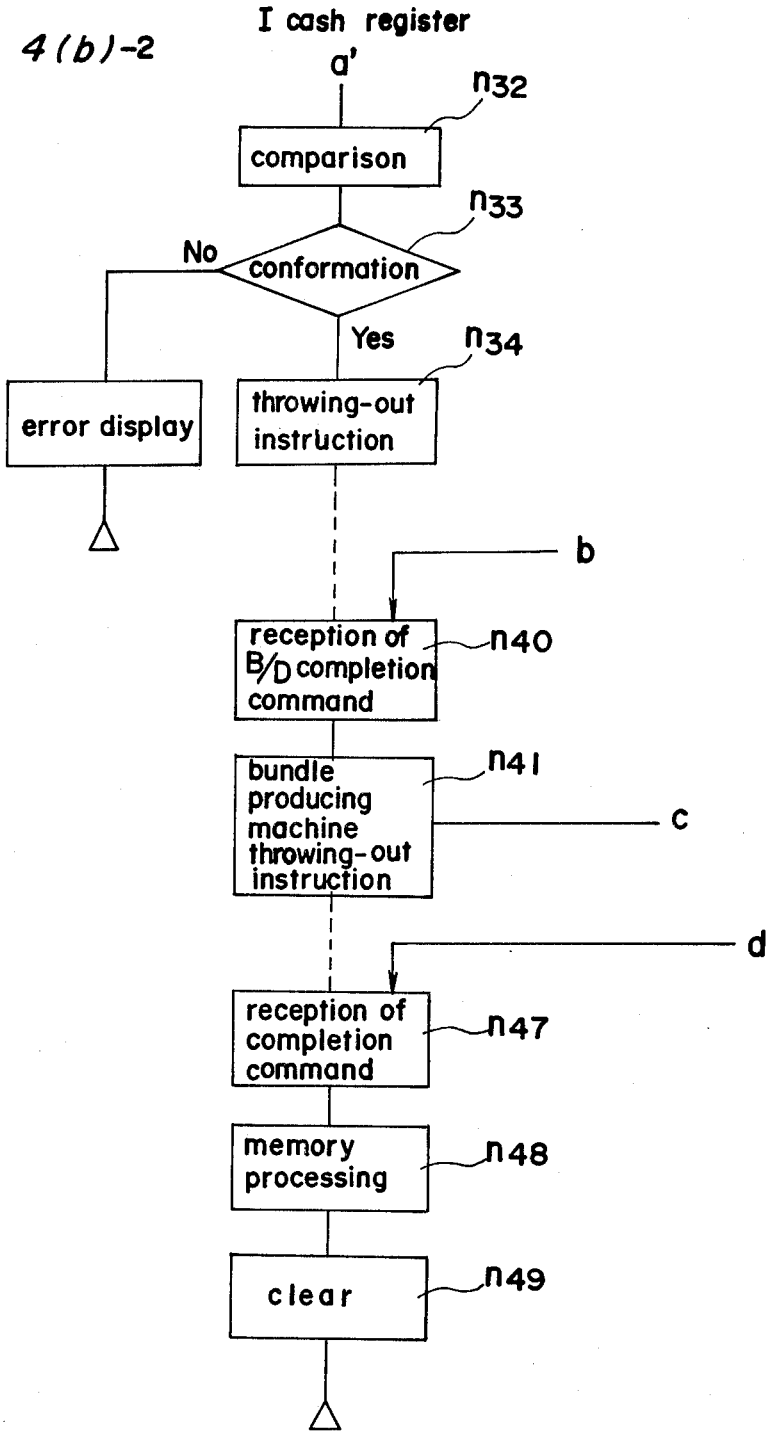
Figures 3, 4B:
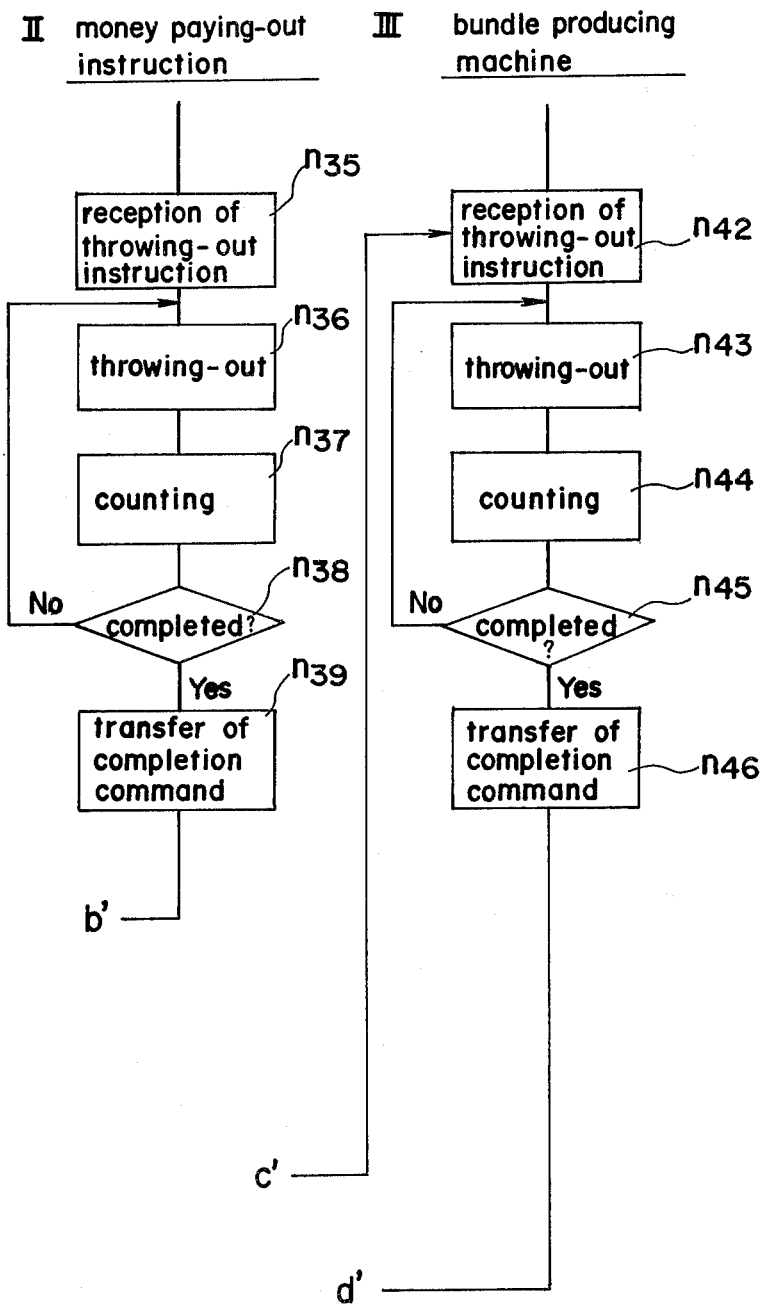

The construction of a cash accounting system in accordance with the present invention will be described hereinafter in connection with a block diagram as shown in FIG. 3.

Referring to FIG. 3, a cash register I, and a coin paying-out apparatus II, which are electrically connected to each other through a connection line L1. Also, a money bundle producing machine III, which pays out money bundles for each of given amount of units, is electrically connected to the cash register I through a connection line L2.

In the cash register I, there provides a function keyboard 31 such as item key or the like, which includes a deposit key a and a paying-out instruction key T. A key discrimination means 32 is provided for the function keyboard 31.

Also, there provides a central processing unit 33, hereinafter referred to as "CPU," which is connected in parallel with the function keyboard 31 through the key discrimination means 32, a numerical value information input means 34 through a key encorder 35 and a money denomination key 36. An address counter 37 connected with the CPU 33 is connected with a primary memory for memorizing data 38 having a paying-out money-denomination memory b, i.e., first memory means, and transaction total memory area c. The primary memory 38 is connected in parallel with a display 41 and a second memory 49 for memorizing each of the registered data through an input/output control means 39 for the memory 38. The CPU 33 is connected in parallel with a printer 40, a data transfer means 50, a data transmission control means 51, a bundle-number memory 48, i.e., second memory means for memorizing the bundle producing data, and a comparison deciding means 46 for feeding a first diciding output to the and a second deciding output to a calculating means 47, in addition to a read-only memory 42, hereinafter referred to as "ROM," for memorizing a micro-program necessary to control the sequence of operation of the CPU 33. Also, the CPU 33 is connected with a throwing-out tolerance amount memory means 45 through an AND gate 44 connected with a mode selecting means 43 for establishing to a set mode the operation mode of the CPU 33. In the throwing-out tolerance amount memory means 45, the number information of the money or money amount, which can be paid out in one paying out operation by the coin paying-out apparatus II to be described later is set and memorized. The throwing-out tolerance amount memory means 45 is connected in parallel with the comparison deciding means 46 and the calculating means 47 which effects the operation of paying-out information for each of money denominations divided by a bundle producing amount unit, for example, 100 papers to calculate the number of the bundles and the remaining amount of each money denomination to be thrown-out. The calculating means 47 is connected through the bundle-number memory 48 with the data transfer means 50 and the data transmission control means 51. The data transfer means 50 is adapted to deliver the money information for each of money denominations to be paid out to the money paying-out apparatus II through the connection line L1. On the other hand, the data transmission control means 51 is adapted to deliver the bundle-number information for each of money denominations to be paid out to the side of the money bundle paying-out machine III through the connection line L2.

In the money paying-out apparatus II, there provides a data transmitting, receiving control means 52 to be connected with the data transfer means 50 of the cash register I for receiving the paying-out information for each of the money denominations to be fed through the line L1. The data transmitting, receiving control means 52 is connected in series with a money throwing-out control means 53, a driving means 54, a money accommodation unit 55 accommodated for each of the money denomination, and a counting means 56 for counting the number of the throwing-out money to stop the throwing operation when the money come to a specified number. The driving means 54 is provided for receiving the signal of the money throwing-out control means 53 to drive the money throwing-out mechanism of a money accommodation unit 55. Also, there provided a means for deciding the throwing-out completion 57 connected between the money throwing-out control means 53 and the counting means 45, and joined to the data transmitting, receiving control means 52 for deciding the completion of the throwing-out operation of all the specified denomination money to deliver a throwing-out completion signal onto the cash register I through the data transmitting and receiving control means 52. In addition, below the counting means 56 there provides a receiving plate 58 for receiving the thrown-out money to be thrown-out from the counting means 56. Also, in the money bundle producing machine III, there provides a data receiving control means 59 to be connected with the data transmission control means 51 of the cash register I for receiving the bundle producing information for each of the money denominations to be fed through the line L2. The data receiving control means 59 is connected in series with a money bundle producing control means 60, a driving means 61, a money accommodating unit 62, and a counting means 63 for counting the thrown-out bundle number of the money to stop the throwing-out operation if the money comes to a specified bundle-number. The driving means 61 is provided for driving the money bundle producing mechanism of the money accommodating unit 62 accommodated in the bundle unit of a given amount, for example, 100 papers for each of money denominations. Also, there provides a means for deciding the throwing-out completion 64 connected between the money bundle producing control means 60 and the counting means 63, and joined to the data receiving control means 59 for deciding the completion of the throwing-out operation of all the specified denomination money bundles to deliver a throwing-out completion signal onto the side of the cash register I through the data receiving control means 59. In addition, below the counting means 63, there provides a receiving plate 65 for receiving the thrown-out money bundles to be thrown-out from the counting means 63.

With the arrangement of I, II, III, as mentioned above, the operation of the cash register system will be described with reference to an operation flow chart shown in FIG. 4. Referring to FIG. 4, (*a*) is a flow chart showing the operation of a set mode, and (*b*) is a flow chart for showing the operation of a registration paying-out mode.

When the cash accounting system of FIG. 3 is used, an operator operates the mode selection means 43 for the register to set the register I to a set mode to preset the various information so as to regulate the function of the cash register 1. At this time, the number of the throwing-out tolerance number by one time of throwing-out operation of the money paying-out apparatus II is memorized, by the numerical-value input means 34 and the money denomination key 36, in the throwing-out tolerance amount storing memory 45 in accordance with the flow chart of FIG. 4(*a*). In this embodiment, assume that the tolerance paper number of the paying-out apparatus II is set to 99 papers.

When the presetting operation of the various information has been completed in this manner, the operator will perform the following common registration (for instance, ordinary account 2,600,000 yen to be paid out with 1,200,000 yen in bills of 10,000 yen and 1,400,000 yen in bills of 5,000 yen will be described hereinafter).

First, the operator depresses a given item key of the function keyboard 31 to instruct to the CPU 33 that the subsequent data to be inputted through the key deciding means 32 is to be registered on an ordinary account (step $n_{21}$). Then, the operator inputs the transaction total 2,600,000 into the CPU 33 through a key encoder 35 by a numerical-value input means 34, and the data to be inputted by this operation is inputted and memorized in the area c of the memory 38 to be specified by an address counter 37 through an input, output control means 39 (step $n_{22}$). Then, to instruct that the operation relates to the payment, the operator depresses the payment key a of the function keyboard 31 to give a payment instruction to the CPU 33 through the key deciding means 32 (step $n_{23}$). In addition, to instruct the account items of the payment of the 2,600,000 yen, the operator inputs to the CPU 33 the number-information of 120 papers in bills of 10,000 yen denomination through the key encoder 35 from the numerical-value input means 34. Then, to instruct that the information is the instruction of the 10,000 yen denomination, depress the 10,000 yen denomination key of the money denomination key 36 to give the 10,000 yen denomination instruction to the CPU33 (step $n_{24}$). The CPU33 which received this instruction operates the comparison deciding means 46 for comparison with the taken-out tolerance-number information of the 10,000 yen denomination memorized in the memory 45 (step $n_{25}$). If the number information inputted this time is equal to or smaller than the number information of the memory 45, the number information inputted this time is memorized as it is in the area b of the memory 38 in response to the first decision result signal of the comparison decision means 46. However, if the number information inputted this time is larger as in this embodiment, the arithmetic means 47 is operated, in response to the second decision result output of the comparison decision means 46, to calculate appointed money-amount divided by unit money denomination×100 or appointed number devided by 100 bills to obtain the number of the bundles i.e., number of 100-bill unit and the sub-amount to be paid out. The bundle-number information is memorized in the bundle-number memory 48 wherein the bundle producing data is memorized, and the sub-amount (20 bills) is memorized in a given area b, which constitutes the first memory means of the memory 38 through the CPU 33 (steps $n_{26}$ through $n_{29}$).

Also, when the operator inputs 280 papers to be paid out in 5,000 yen bills in the same manner, two bundles, which are the integer magnification of the bundle producing amount unit (100 papers), are memorized in the bundle-number memory 48 where the bundle producing data is memorized. Also, the sub-amount paper-number 80 papers are memorized in the given area b of the memory 38.

When the registration of the paying-out items for each money denomination of 10,000-yen bill, 5,000-yen bill, 1,000-yen bill and 500-yen bill has been completed (step $n_{30}$), the operator depresses the throwing-out instruction key T of the function keyboard 31 to give the throwing-out instruction of the money to the CPU 33 through the key deciding means 32 (step $n_{31}$). The CPU 33 which received this throwing-out instruction, effects its comparing operation as to whether or not the paying-out sum total money inputted at first conforms to the sum total money of the item money denominations (step $n_{32}$). When they have conformed to each other (step $n_{33}$), the CPU 33 transfers the money throwing-out instruction together with the paying-out money denomination data to be memorized in the area b of the memory 38 to the data transmitting, receiving control means 52 on the side of the money paying-out apparatus II through the data transferring means 50 (step $n_{34}$).

The money paying-out apparatus II which has received the throwing-out instructions and the money denomination data, (step $n_{35}$) throws out to a receiving plate 58 the money of number specified by a driving means 54 from each money accommodating means 55 under the control of the throwing-out control means 53 (step $n_{36}$). At this time, the throwing-out money number is counted by a counting means 56 (step $n_{37}$) to stop the throwing-out operation when the money comes to the specified number.

When the throwing-out operation of all the specified money denomination has been completed in this manner (in accordance with the example, the throwing-out operation of 20 papers in the bill of 10,000 and 80 papers in the bill of 5,000), the throwing-out completion deciding means 57 is operated (step $n_{38}$), a throwing-out completion instruction is fed to the cash register I by a data transmitting control means 52 (step $n_{39}$).

On the other hand, the cash register I receives the throwing-out completion instruction signal (B/D completion command) through a data transferring means 50 (step $n_{40}$). Then, the CPU 33, which has received this throwing-out completion instruction feeds the bundle number throwing-out instruction to the money-bundle producing machine III, the bundle-number throwing-out instruction, together with the memory contents of the bundle-number memory 48, through the data transmitting control means 51 (step $n_{41}$). The bundle producing machine III, which has received, through the receiving control means 59, the throwing-out instruction and the throwing-out data of the bundle-number memory 48 (step $n_{42}$) throws out, to the receiving plate 65, the money of the bundle-number specified by the driving means 61 from the money bundle accommodating portion 62 under the control of the bundle producing control means 60 (step $n_{43}$), i.e., 10,000-yen bill bundle, one bundle, 5,000-yen bill bundle, two bundles. The number of the throwing-out bundles is counted by a counting means 63 (step $n_{44}$) to stop the throwing-out operation if the number comes to the number of the specified bundles. When the bundle throwing-out operation of all the specified money denominations has been completed in this manner, the throwing-out completion deciding means 64 is operated (step $n_{45}$). The throwing-out completion instruction is fed to the cash register 1 by a data transmission control means 59 (step $n_{46}$).

The CPU 33 which has received the throwing-out completion instruction (step $n_{47}$) stores the data, etc. memorized in the memory 38 and the memory 48, as they are or compiled in a secondary memory 49 (step $n_{48}$). At a time point when the memory processing has been completed, the stored contents of the memories 38 and 48 are cleared to prepare for the following transaction registration (step $n_{49}$).

According to the present invention as described hereinabove, there provides a cash accounting system wherein a cash register for registering various money transaction information is electrically connected with a money paying-out apparatus for paying-out money such as papers, coins or the like corresponding to the paying money amount caused by each transacting registration, characterized in that a money bundle producing machine for paying-out money for each of given amount units is electrically connected with said cash register, a deciding means for determining whether or not the paying information for each of money denominations corresponding to said payment money amount is a predetermined given amount or more, the money amount of said given amount or less is thrown out of said money paying-out apparatus in accordance with the determining output of said deciding means, the money of the integer magnification of the given amount is adapted to be thrown out of said money bundle producing machine. The bundle-producing money amount and the throwing-out money amount provided from the paying-out apparatus are calculated within the cash register even if the paying-out instruction more than the throwing-out tolerance number of the money paying-out apparatus is given. The money amount specified in accordance with the throwing-out instruction is automatically thrown out by the money paying-out apparatus and the money bundle producing machine. Thus, the operating time in the paying-out business of the lots of money amount is reduced and the operation error is prevented, thus being extremely practical and useful.

Although the present invention has fully been described in connection with the preferred embodiments thereof with reference to the accompanying drawings, it is to be noted that various changes and modification are apparent to those skilled in the art. In such changes and modifications are to be understood as included within the scope of this invention unless they depart therefrom.

What is claimed is:

1. A cash accounting system wherein a cash register for registering various money transaction information is electrically connected with a money paying-out apparatus for paying-out money such as papers, coins or the like corresponding to the paying money amount caused by each transacting registration, comprising a money bundle producing machine for paying-out money for each of given amount units and electrically connected with said cash register, and a deciding means for determining whether or not the paying information for each of money denominations corresponding to said payment money amount is a predetermined given amount or more, whereby the money amount of said given amount or less is thrown out of said money paying-out apparatus in accordance with the determining output of said deciding means, and the money of the integer magnification of the given amount is adapted to be thrown out of said money bundle producing machine.

* * * * *

UNITED STATES PATENT AND TRADEMARK OFFICE

CERTIFICATE OF CORRECTION

PATENT NO. : 4,443,692

DATED : April 17, 1984

INVENTOR(S) : Nishimura

It is certified that error appears in the above-identified patent and that said Letters Patent are hereby corrected as shown below:

In the Heading of the Patent, in the Title, change "CASE" to --CASH--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*